US007562412B1

(12) United States Patent
Anderson

(10) Patent No.: US 7,562,412 B1
(45) Date of Patent: Jul. 21, 2009

(54) BATTERY POWERED RIDING FLOOR STRIPPING MACHINE

(76) Inventor: Martin L. Anderson, 6852 Estes Ave., NW., Maple Lake, MN (US) 55358

( * ) Notice: Subject to any disclaimer, the term of this patent is extended or adjusted under 35 U.S.C. 154(b) by 96 days.

(21) Appl. No.: 11/620,299

(22) Filed: Jan. 5, 2007

Related U.S. Application Data

(63) Continuation-in-part of application No. 11/042,230, filed on Jan. 25, 2005, now abandoned.

(51) Int. Cl.
*A47L 11/12* (2006.01)
*A47L 13/02* (2006.01)

(52) U.S. Cl. ..... 15/93.1; 299/37.1

(58) Field of Classification Search ..... 15/49.1, 15/93.1; 299/37.1
See application file for complete search history.

(56) References Cited

U.S. PATENT DOCUMENTS 2,197,154 A * 1/1940 Miller ..... 299/37.4
5,702,161 A * 12/1997 Finney et al. ..... 299/37.1
5,800,021 A * 9/1998 Derr ..... 299/37.1
6,016,585 A * 1/2000 Allen ..... 15/93.1
6,135,566 A * 10/2000 Anderson ..... 299/37.1
6,273,513 B1 * 8/2001 Pope ..... 299/36.1
6,299,257 B1 * 10/2001 Constantino ..... 299/36.1
6,513,881 B2 * 2/2003 Pope ..... 299/36.1
6,571,542 B1 * 6/2003 Fillman et al. ..... 56/10.6
6,666,522 B2 * 12/2003 Bloom ..... 299/36.1
6,896,468 B2 * 5/2005 Gallea et al. ..... 414/395
7,316,861 B2 * 1/2008 Scita ..... 429/96

* cited by examiner

*Primary Examiner*—Randall Chin
(74) *Attorney, Agent, or Firm*—Nikolai & Mersereau, P.A.; Thomas J. Nikolai

(57) ABSTRACT

A floor stripping machine having the electric motor and hydraulic pump placed just aft of the blade engages adds weight to the blade and provides for a narrower more compact design with a lower center of gravity for better maneuverability and ease of access to narrow halls, doorways and rooms. A battery powered floor stripping machine may have batteries stored in the housing under the seat and have auxiliary batteries behind the seat on top of the housing for easy of removing the batteries for recharging. Additional batteries and or weights can be used on either side of the housing. In alternative embodiments the floor stripping machine can be remote controlled. Battery management with the auxiliary batteries being recharged during the day allows for eight hours of use. A trunk may store batteries, which can be slid onto a trailing cart to change batteries.

20 Claims, 6 Drawing Sheets

BATTERY POWERED RIDING FLOOR STRIPPING MACHINE

This application is a continuation-in-part of application Ser. No. 11/042,230 filed Jan. 25, 2005, now abandoned.

BACKGROUND OF THE INVENTION

1. Field of the Invention

This invention relates to a battery operated floor stripping machine for stripping materials, such as adhesive bonded floor coverings, from floor surfaces, and more particularly to changing batteries in the machine wherein the batteries are a major component of weight distribution and power management by efficient changing of batteries.

2. Description of the Related Art

In one version of battery powered riding floor stripping machine the electric motor, hydraulic pump and hydraulic motors are all inside of the housing in the back portion of the machine. This takes up space inside of the machine and places weight over the rear wheels. Weights therefore have to be added to the front of the machine to increase performance of the blade on the floor. The space taken up in the housing on the back portion of the machine by the electric motor, and hydraulic pump decreases the space available for batteries, hydraulic oil tanks and other needed equipment and reduces the ability to cool the electric motor when it is contained inside of the housing in the back portion of the machine. The space taken by the electric motor and hydraulic pump in the housing in the back portion of the machine requires the housing to be larger and therefore the stripping machine larger than need be, reducing the ability to have a smaller vehicle with a better turning radius, lower center of gravity and better maneuverability which allows easier access to compact spaces in buildings such as elevators, hallways, doorways and smaller rooms.

The electric motor, hydraulic pump and hydraulic motors all inside the housing in the back portion of the machine is harder to work on for maintenance or replacement than a design having the electric motor and hydraulic pump in a separate housing in front of the machine.

Battery operated floor stripping machines need to be able to run during an entire eight hour work day without down time for recharging. Most battery operated machines do not have an eight hour capacity particularly with internally housed batteries. It is desirable to have supplementary, easy to exchange, accessible batteries in addition to the internally housed batteries. It is also desirable to be able to easily change the internal batteries for replacing the batteries with a charged battery and for replacing old batteries with new ones.

Corded electric motor floor stripping machines have had the weight of the electric motor and hydraulic systems in the housings near the rear wheels of the floor stripping machine. The corded floor stripping machines can also benefit from having the electric motor and hydraulic pump moved in front of the rear housing to better distribute the weight of the machine to the blade.

Safety and convenience are concerns when changing heavy batteries particularly when there is a lone machine operator and the batteries are placed in a position high up in the vehicle.

Further it is desirable to change the batteries as few times as possible during a work shift to avoid downtime on the machine and to reduce the work load of the machine operator required for battery changes.

SUMMARY OF THE INVENTION

The battery operated floor stripping machine of the present design has a rear housing with independently controlled hydraulic motor powered rear wheels, a hydraulic tank which encompasses the hydraulic motors, a battery rack and a top cover which hingedly opens for access to the batteries. A seat is attached to the top cover and alternatively a battery rack may be attached to the top cover behind the seat for extra batteries, which can be easily added for extra battery capacity and easily removed for recharging.

The battery operated floor stripping machine has a blade in front of the motor housing for engaging the floor and removing flooring materials to strip the floor. The blade has an adjustable angle of attack to engage the flooring material at the most efficient angle for the type of flooring material being stripped. To increase the weight on the blade the electric motor is placed between the rear housing and the blade. The motor in front of the rear housing has its own housing and is also easier to work on for maintenance and easier to replace. Further the motor in the front of the rear housing is easier to cool. The hydraulic pump is placed on top of the electric motor to further add weight to the front of the floor stripping machine. The electric motor and hydraulic pump being in a separate housing in front of the rear housing allows for better use of space. The rear housing has less in it, so it can be narrower and not as high for a lower center of gravity. The rear housing can now have larger batteries. The electric motor and hydraulic pump in front of the rear housing allows for narrower more compact design.

In an alternative embodiment extra batteries may be used inside of the rear housing on either side of the tank near the front of the rear housing. Extra weights may also be placed inside of the rear housing on either side of the tank, or a combination of extra batteries and weights.

In another embodiment a remote control receiver can be used for controlling the direction and speed of the battery powered floor stripping machine and the position of the blade, allowing the user to stand in the room and control the floor stripping machine without riding on it. If the batteries are removed and a cord is used to supply power to the floor stripping machine the user having a remote control can maneuver the cord while operating the floor stripping machine.

By having large battery packs to power the floor-stripping machine the batteries can power the floor-stripping machine for about four hours before a change is needed. Therefore the machine will only have to be pulled from floor stripping duty one time during a typical eight hour work shift to change the batteries. By having a cart with batteries thereon which can be used to slide the batteries onto when they need recharging and by using a cart to bring recharged batteries to the floor-stripping machine to slide onto the floor-stripping machine the batteries can be quickly and easily changed.

The cart containing the batteries can be attached to the back of the floor stripping machine for transporting the floor-stripping machine and batteries to or from a job cite. The cart can be used to recharge the batteries on. The cart may have recharging equipment thereon.

OBJECTS OF THE INVENTION

It is an object of the invention to increase the weight of the floor stripping machine in the front portion near the blade to increase the floor stripping ability.

It is an object of the invention to lower the center of gravity of the floor stripping machine.

It is an object of the invention to move the electric motor and hydraulic pump to the front of the floor stripping machine so as to have more room for batteries in the rear housing.

It is an object of the invention to provide for a highly maneuverable floor stripping machine.

It is an object of the invention to provide for a compact floor stripping machine.

It is an object of the invention to provide for a narrow floor stripping machine.

It is an object of the invention to provide for a long running battery powered floor stripping machine.

It is an object of the invention to provide easy access to the motor for repair, maintenance and replacement.

It is an object of the invention to run the battery powered floor stripping machine during the entire work day without down time for recharging the batteries.

It is an object of the invention to run the battery powered floor stripping machine either remotely or with a rider operator.

It is an object of the invention to use a corded power source to the electric motor and a remote control.

It is an object of the invention to use a corded power source to the electric motor with the motor in front of the floor-stripping machine.

It is an object of the invention to provide a battery powered floor-stripping machine with batteries for operating the floor-stripping machine for as long a duration as possible without changing batteries.

It is an object of the invention to provide a battery powered floor-stripping machine with batteries, which can be quickly and easily changed by one person.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
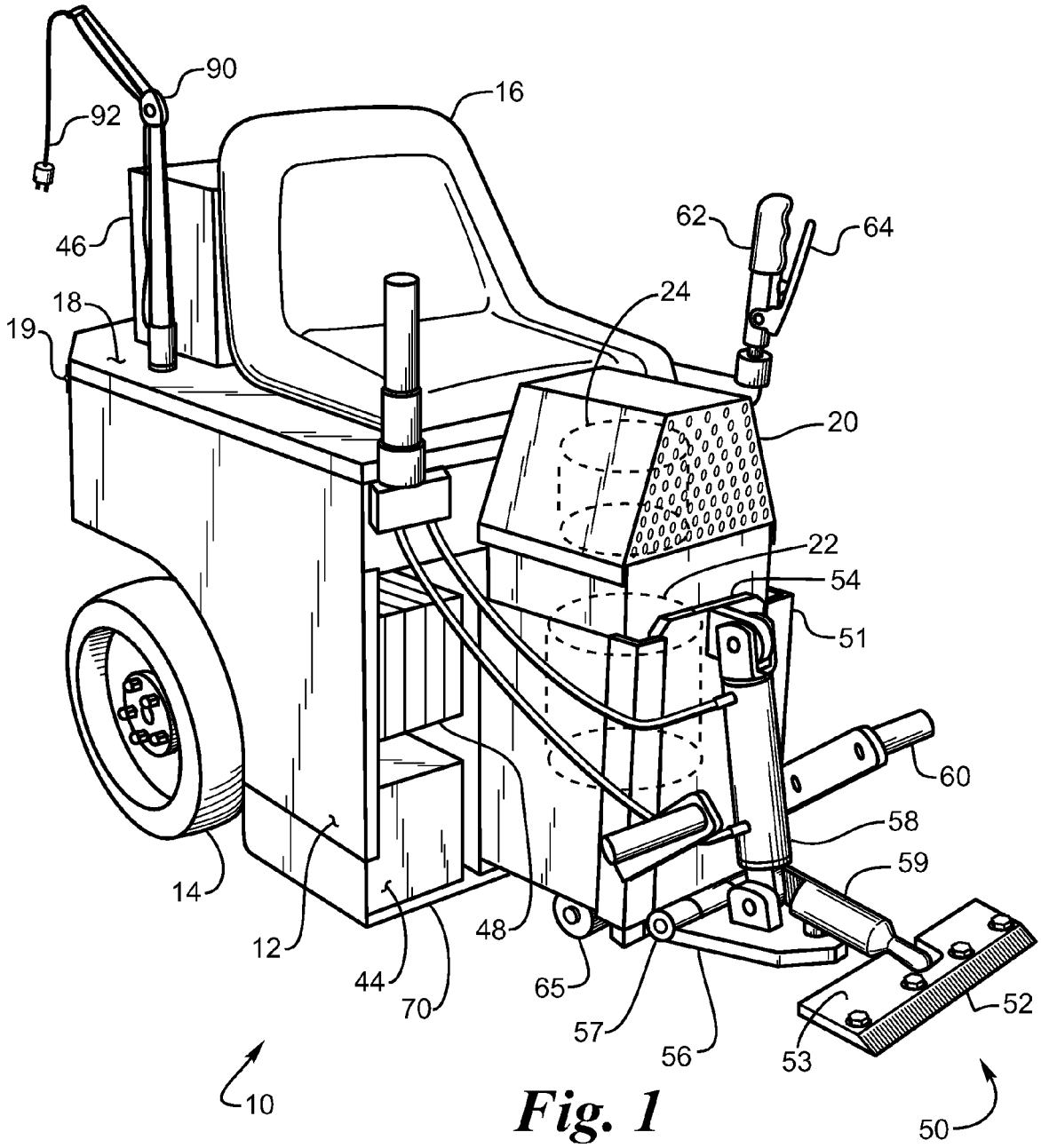
FIG. 1 shows a front right perspective view of the floor stripping machine.
Figure 2:
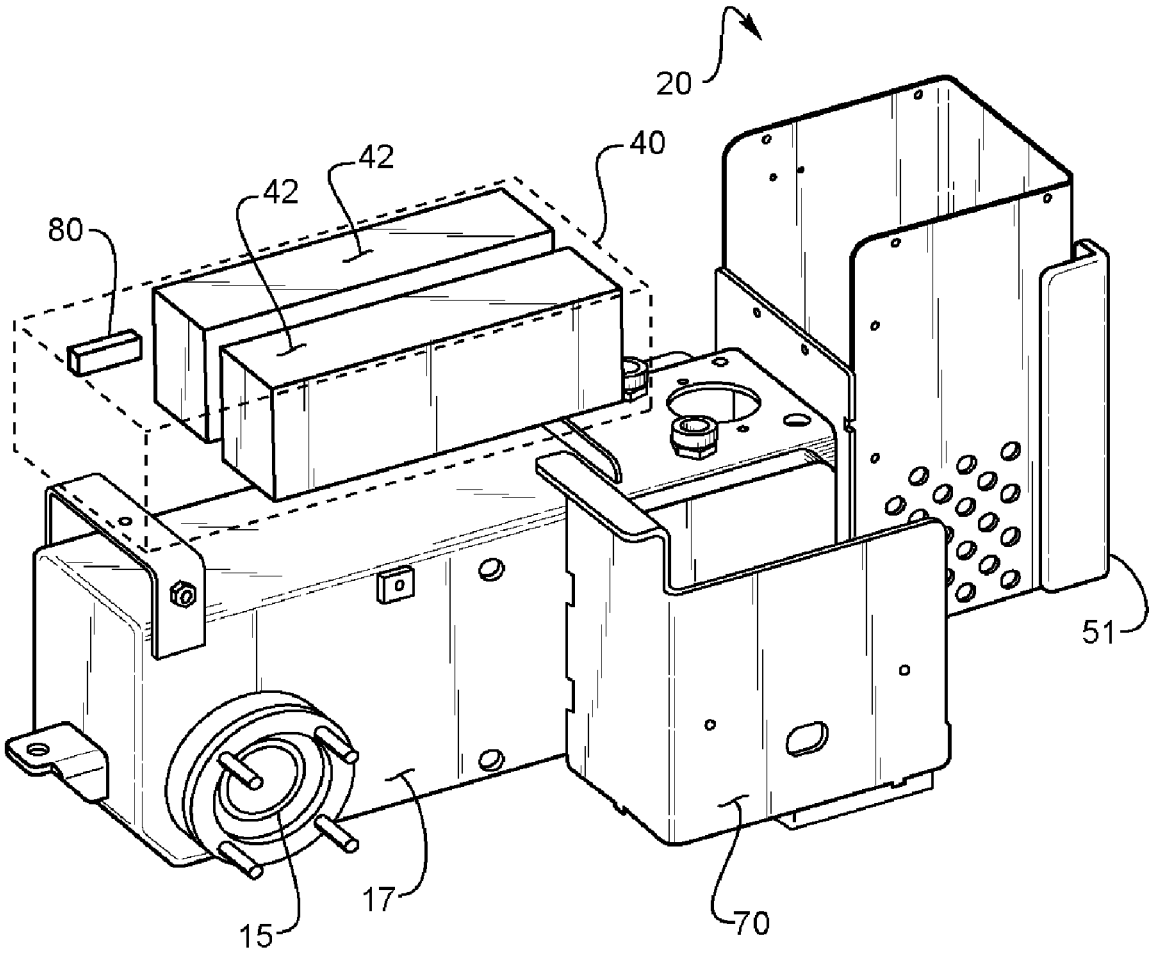
FIG. 2 shows a side perspective view of the tank and frame of the floor stripping machine.
Figure 3:
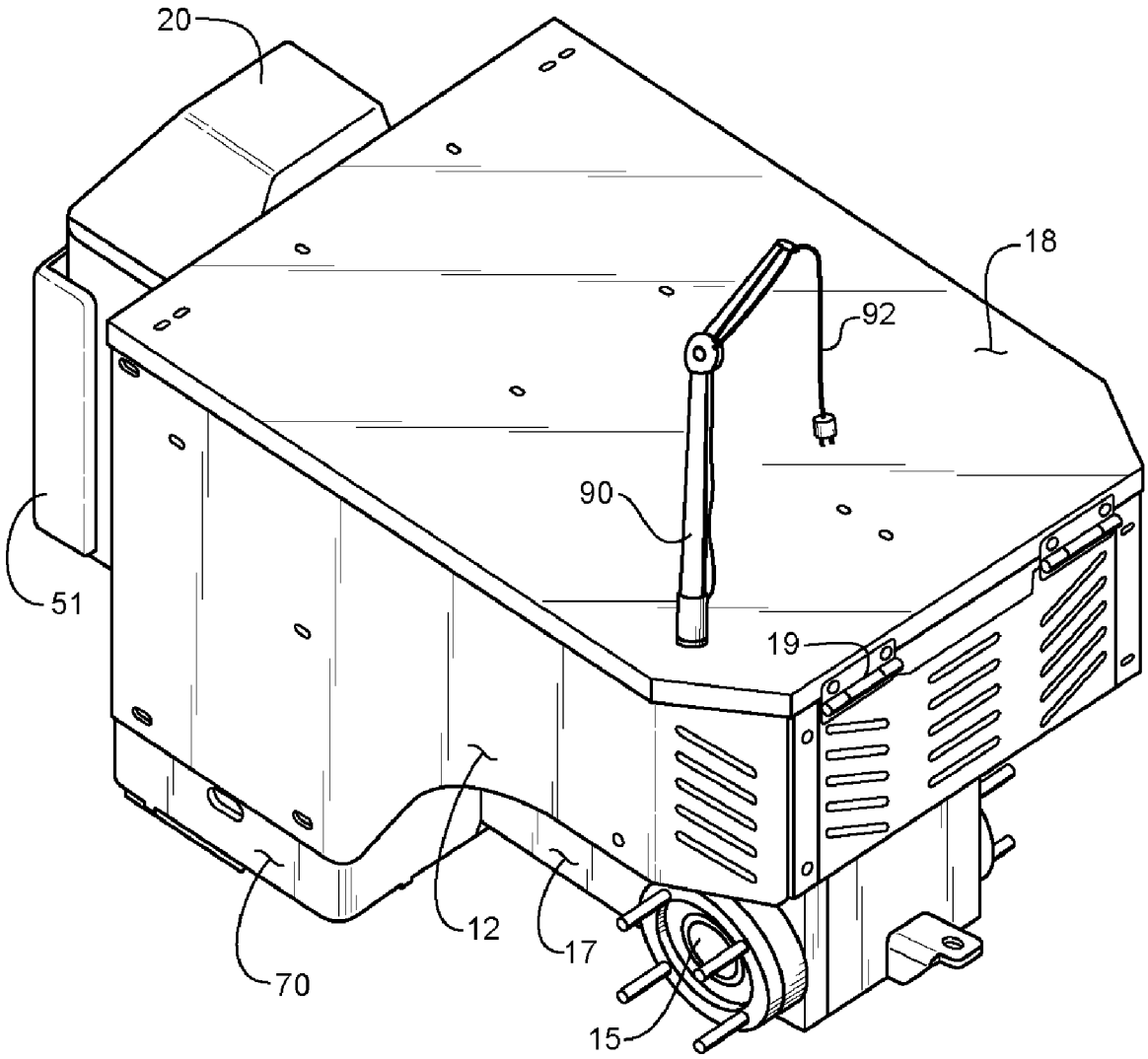
FIG. 3 shows a left rear perspective view of the floor stripping machine rear housing and motor housing.
Figure 4:
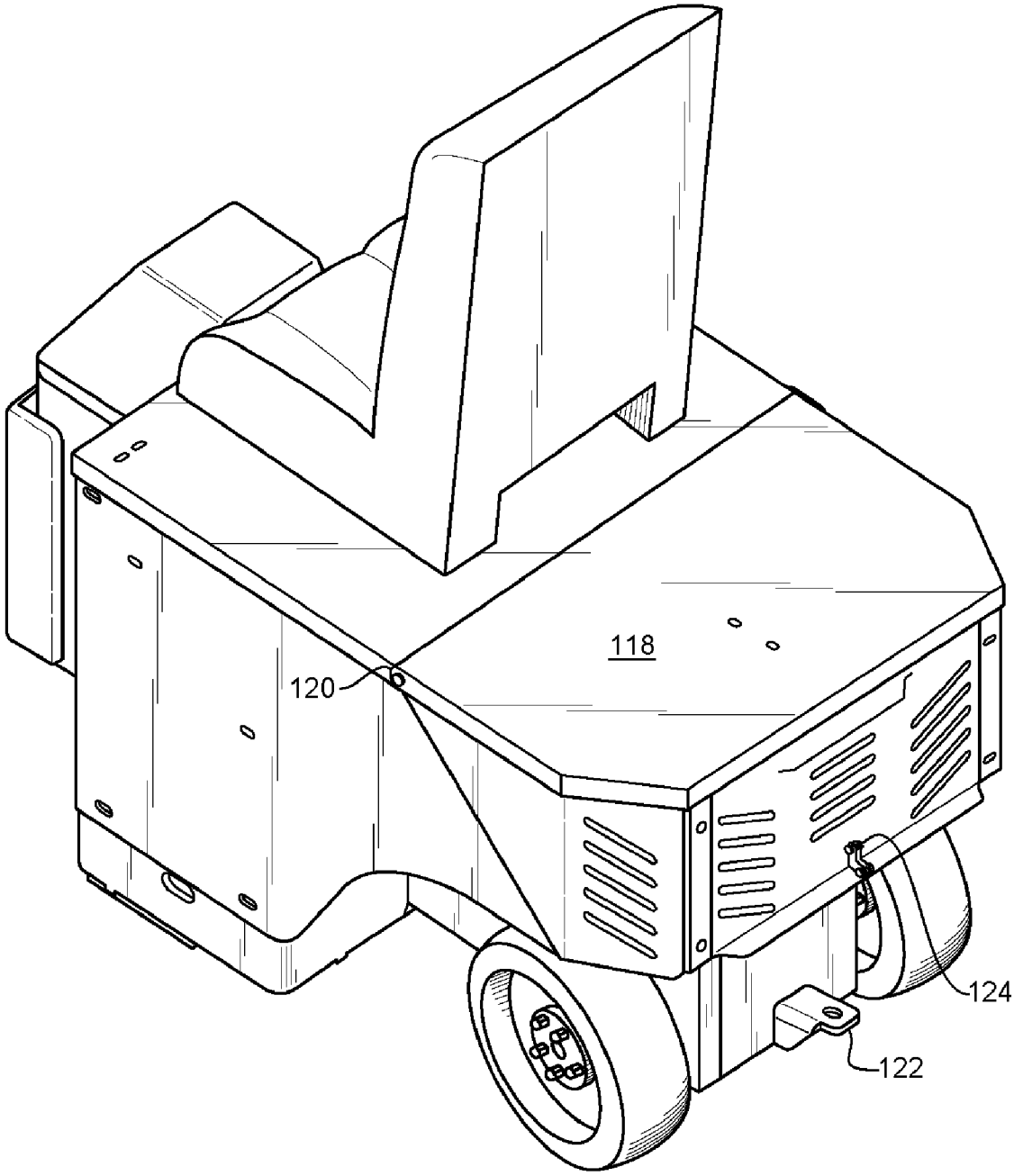
FIG. 4 shows a rear perspective view of the floor stripping machine with a rear door for replacing batteries.
Figure 5:
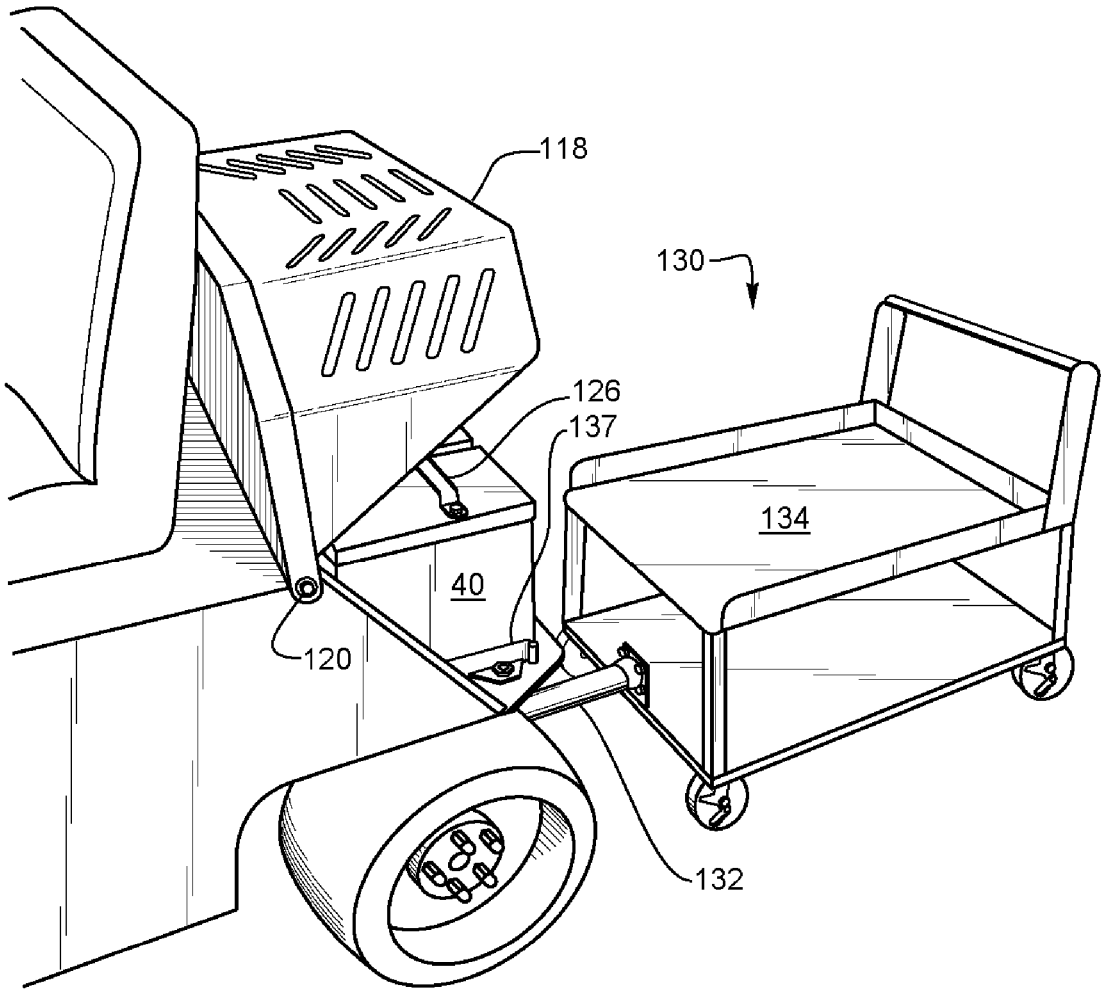
FIG. 5 shows a side perspective view of the floor stripping machine with a rear door open and a cart for replacing batteries.
Figure 6:
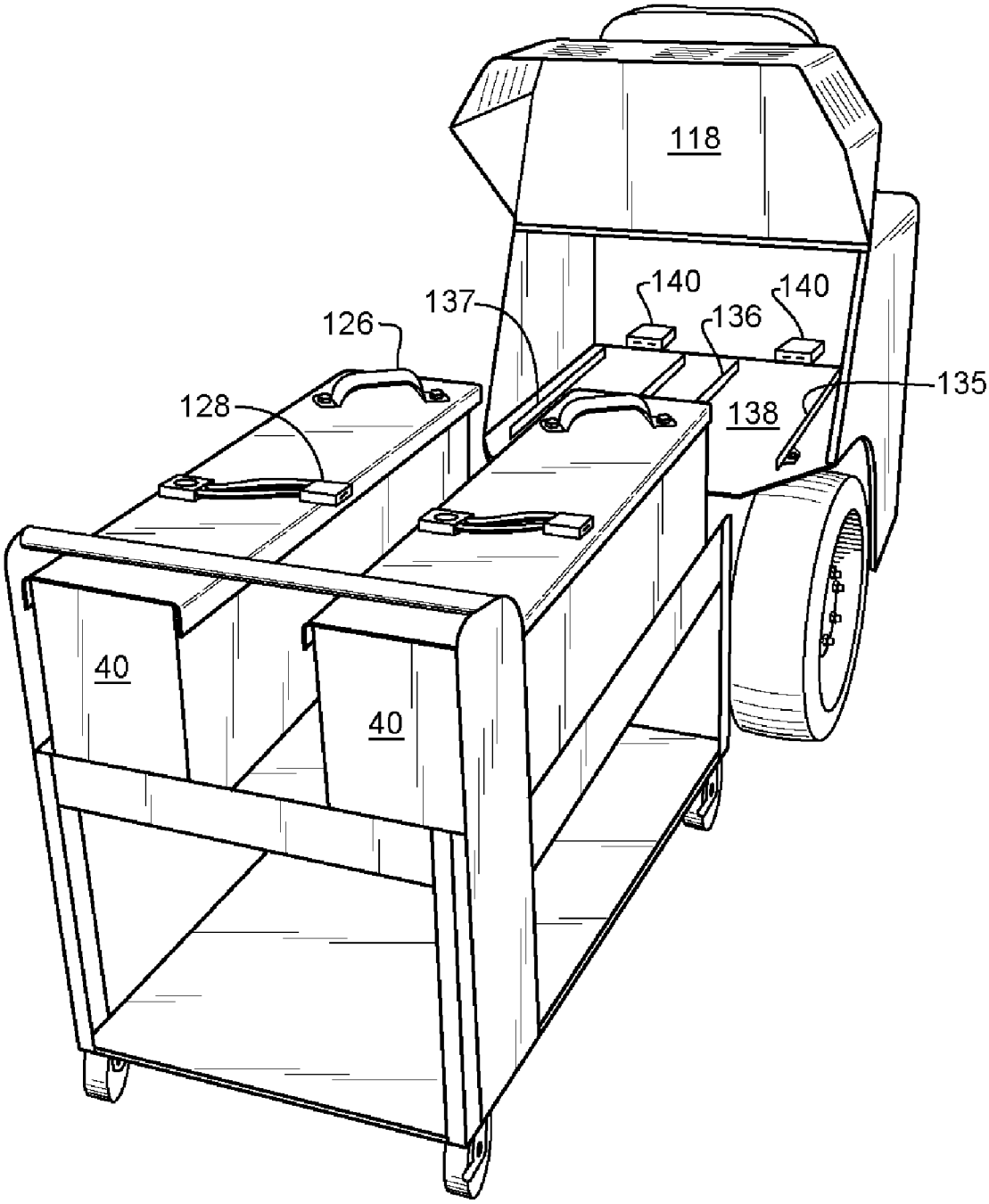
FIG. 6 shows a rear perspective view of the floor stripping machine with a rear door open and a cart for replacing batteries with batteries thereon.

The floor stripping machine 10 is shown in general in FIG. 1. It has a rear housing 12 with a pair of drive wheels 14 in the rear. The drive wheels 14 are preferably individually controlled and have separate hydraulic motors 15 or alternatively individual electric motors. In the embodiment shown the hydraulic motors 15 are surrounded by tank 17 containing hydraulic fluid. Seat 16 is located on top of rear housing 12. The seat 16 is attached to a hinged cover 18 with the hinge 19 at the back so that the hinged cover swings open backward exposing one or more batteries 42 inside of battery housing 40 on top of tank 17. Placing the batteries 42 over the tank 17 allows easy access to the batteries by pivoting the hinged cover 18, which exposes the batteries 42 for replacing the batteries with new batteries or with recharged batteries.

A motor housing 20 is placed in the front of rear housing 12 to place the weight of the electric motor 22 near the blade 52. The electric motor 22 drives hydraulic pump 24 which is also placed forward, in the front of the housing 12, to add weight to the front of the floor stripping machine 10 applying more weight to a blade 52 attached to blade holder 53.

The blade holder 53 is attached to blade plate assembly 50, which controls the angle of blade 52 as it engages the floor. The blade plate assembly 50 has a vertical adjustable position blade plate 54 mounted in front of the motor housing 20. The vertical adjustable blade plate 54 can be moved vertically on blade plate bracket 51, which is attached to the front of motor housing 20. When the floor stripping machine 10 is being moved and flooring is not being stripped the vertical adjustable position blade plate 54 can be raised and/or blade plate 56 tilted up by piston 58 being actuated, thereby pivoting blade plate 56 on hinge 57 so that rod 59 holds the blade holder 53 off the floor. The front wheel 65 engages the floors allowing the floor stripping machine 10 to roll freely on wheels 65 without the blade 52 engaging the floor. When it is desired to strip a floor, vertical adjustable position blade plate 54 can be lowered or the angle of blade plate 56 adjusted such that the blade 52 can engage the floor. The position of blade holder 53 to the floor can be adjusted by piston 58 to place the weight of the front of the floor stripping machine 10 on the blade 52 at an angle and depth to strip the flooring in the most efficient manner. The weight being placed on the blade 52 is increased by having the electric motor 22 and hydraulic pump 24 placed as close to the blade 52 as possible and using piston 58 to adjust the angle and height of the blade 52 for best performance of removing material from the floor.

In alternative embodiments the floor stripping machine 10 can have extra batteries 46 placed behind the seat 16 on top of the hinged cover 18. These extra batteries 46 being on top of the housing 12 make it easy for the batteries 46 to be changed. In this manner the batteries 46 can be used at the beginning of the day when they are fully charged. After batteries 46 run down and need recharging they can be removed and recharging commenced while the remaining batteries 42 inside housing 40 power the floor stripping machine 10. Later in the day when batteries 42 are running down, batteries 46 are recharged and can be reinstalled on housing 12 to power the floor stripping machine 10 until the end of the work day. Similarly a second set of batteries 46 can be charging when a first set of batteries 46 is in place on top of housing 12.

During the overnight hours only two chargers would be required, one for the batteries 42 inside of the housing 12 and one charger for the batteries 46.

In a further alternative embodiment additional batteries 44 may be installed in battery housing 70 for longer life between battery charges. If more weight is required on blade 52 extra weights 48 may be used in battery housing 70 either with or without batteries 44. Both batteries 44 and 46 are wired into the power circuit to provide additional operating time for the floor stripping machine 10.

in another alternative embodiment, as shown in FIGS. 3-6, a cart 130 can be attached to the floor stripping machine 10 by means of a cart hitch 122 for attaching cart tongue 132 on cart 130. The floor stripping machine can then tow the cart 130 behind the floor stripping machine 10. The floor stripping machine 10 has a trunk lid 118 which pivots on trunk hinge 120 between the open and closed positions. When in the closed position batteries 42 are secured inside of the trunk. Trunk latch 124 secures the trunk lid 118 in the closed position. When the trunk lid 118 is opened batteries 42 which are heavy can easily be slid onto cart 130 as the cart shelf 134 is at the same height as the trunk base 138. The handles 126 on the batteries 42 can be used to slide the batteries onto the cart 130. The cart tongue 132 being attached to the floor stripping machine 10 prevents the cart 130 from moving relative to the floor stripping machine 10 during the battery transfer process.

A cart 130 carrying freshly charged batteries 42 can be driven onto the job site in the morning and the batteries 42 from the cart 130 used to replace the batteries 40 taken out and placed on an empty cart 130 approximately half way though an eight hour shift. When charged batteries on cart 130 are slid onto trunk base 138 they are placed between the right guide rail 135 and the center rail 136 for the right battery 42 and between the left guide rail 137 and the center rail 136 for the left battery 42. Battery plugs 128 are then plugged into motor plugs 140 and the trunk lid 118 is closed and latch 124 closed. The cart 130 can then be detached at cart hitch 122 for easier maneuverability of the floor stripping machine 10 during operation. Batteries not in use in the floor stripping machine 10 can be recharged while on cart 130. The batteries may be provided with rollers or the cart shelf 134 and trunk base 126 may have rollers to help make the batteries easier to move.

In the embodiment shown in the figures the user would ride in seat 16 and use foot pedals 60 and hand controls 62 to control the floor stripping machine 10. Hand control 62 has safety on off switch 64 for disengaging the power to the electric motor 22 when the rider lets go of the switch 64. Riding on the floor stripping machine may not be desirable, therefore a remote control system may be used in conjunction with a remote control receiver 80 having a control card in housing 12 to receive signals from a transmitter operated by the user to operate the direction and speed of the floor stripping machine and also to control the blade height and angle. Operating the floor stripping machine remotely may give the operator a different or better view of the blade position than if riding on the machine for better control of the floor stripping process.

In an alternative embodiment the batteries may be removed and an electrical cord 92 plugged into a power source in the building may power the electric motor 22. The cord 92 is frequently in the way of the floor stripping machine 10 and may have a holder 90 to keep the cord 92 in the air near the floor stripping machine 10. With a remote controlled corded floor stripping machine 10 the operator can stand away from the floor stripping machine and move the cord around so that the floor stripping machine 10 does not run over or become entangled in the cord 92.

Although the preferred embodiment shown has hydraulic motors to drive the wheels electric motors or other power sources may be used to drive the floor stripping machine wheels.

Obviously, many modifications and variations of the present invention are possible in light of the above teachings. It is therefore to be understood that, within the scope of the appended claims, the invention may be practiced otherwise than as specifically described.

What is claimed is:

1. A floor stripping machine comprising:

a rear housing section having a pair of rear wheels and a motor for driving each of the rear wheels, a motor section attached to the front of the rear housing section, and an adjustable blade assembly comprising a blade plate bracket attached to the front of the motor section, a first vertically adjustable blade plate positioned generally perpendicular to the floor surface and held by the blade plate bracket, a second blade plate;

a hinge attached at the base of the first blade plate for pivotally connecting the second blade plate to the first blade plate, a blade holder, a floor scraping blade supported by the blade holder, a rod member connecting the blade holder to the second blade plate, the adjustable blade assembly being such that the weight distribution of the motor section adds weight to the front of the floor stripping machine to increase the effectiveness of the floor scraping blade.

2. A floor stripping machine as in claim 1 wherein, the motor section contains an electric motor and at least one battery is enclosed in the rear housing section.

3. A floor stripping machine as in claim 2 wherein, at least one battery is placed on the top of the rear housing section.

4. A floor stripping machine as in claim 3 wherein, at least one battery is placed in at least one of the sides of the rear housing section near the front.

5. A floor stripping machine as in claim 1 wherein, an electric motor drives a hydraulic pump and the rear wheels are driven by hydraulic motors.

6. A floor stripping machine as in claim 1 wherein, a cord holder is attached to the rear housing section for holding a power cord which provides power to the motor.

7. A floor stripping machine as in claim 1 wherein, a seat on top of the rear housing section for supporting a user who rides on and controls the floor stripping machine.

8. A floor stripping machine as in claim 7 wherein, a control handle having an on/off safety switch is attached to the rear housing section.

9. A floor stripping machine as in claim 1 wherein, a remote control receiver in the floor stripping machine receives control signals for controlling the floor stripping machine.

10. A floor stripping machine as in claim 2 wherein, the electric motor drives a hydraulic pump and the rear wheels are driven by hydraulic motors.

11. A floor stripping machine as in claim 10 wherein, at least one battery placed on the top of the housing section.

12. A floor stripping machine as in claim 11 wherein, at least one battery placed in at least one of the sides of the housing section near the front.

13. A floor stripping machine as in claim 11 wherein, a remote control received in the floor stripping machine receives control signals for controlling the floor stripping machine.

14. A floor stripping machine as in claim 11 wherein, a seat on top of the housing section for supporting a user who rides on and controls the floor stripping machine.

15. A floor stripping machine as in claim 14 wherein, a remote control received in the floor stripping machine receives control signals for controlling the floor stripping machine.

16. A floor stripping machine as in claim 2 wherein, a trunk lid on the rear housing section opens to access the batteries therein.

17. A floor stripping machine as in claim 16 wherein, the rear housing section has a base for supporting the batteries, a cart having a tongue for attaching to a cart hitch on the floor stripping machine, the cart having a shelf at the same height as the housing section base to facilitate moving the batteries between the cart and the floor stripping machine.

18. A floor stripping machine as in claim 17 wherein, the batteries have handles thereon and the batteries plugs for connecting to plugs on the floor stripping machine to supply power to the motor.

19. A floor stripping machine as in claim 16 wherein, an electric motor drives a hydraulic pump and the rear wheels are driven by hydraulic motors.

20. A floor stripping machine as in claim 16 wherein, a seat on top of the rear housing section for supporting a user who rides on and controls the floor stripping machine.

* * * * *